United States Patent [19]

Tanaka

[11] 4,109,349

[45] Aug. 29, 1978

[54] SLIDE FASTENER

[75] Inventor: Akira Tanaka, Kurobe, Japan

[73] Assignee: Yoshida Kogyo K.K., Japan

[21] Appl. No.: 753,480

[22] Filed: Dec. 22, 1976

[30] Foreign Application Priority Data

Dec. 29, 1975 [JP] Japan ..... 50-177586[U]

[51] Int. Cl.[2] ..... A44B 19/36

[52] U.S. Cl. ..... 24/205.11 R

[58] Field of Search ..... 24/205.11 R, 205.11 F

[56] References Cited

U.S. PATENT DOCUMENTS

| | | | |
|---|---|---|---|
| 1,960,202 | 5/1934 | Carr | 24/205.11 R |
| 2,044,161 | 6/1936 | Forster | 24/205.11 R |
| 2,267,384 | 12/1941 | Waldes | 24/205.11 R |
| 2,894,305 | 7/1959 | Brown | 24/205.11 R |
| 2,988,796 | 6/1961 | Johns | 24/205.11 R |

FOREIGN PATENT DOCUMENTS

| | | | |
|---|---|---|---|
| 553,551 | 5/1943 | United Kingdom | 24/205.11 R |

*Primary Examiner*—Bernard A. Gelak

*Attorney, Agent, or Firm*—Bucknam and Archer

[57] ABSTRACT

A slide fastener comprises a pair of end stop members of identical configuration for limiting the closing or upward movement of a slider along fastener elements carried along the inner confronting edges of a pair of stringer tapes, the end stop members being secured respectively to the upper ends of the stringer tapes in opposed relationship to each other. Each of the end stop members has a recess to permit an area of contact of the slider neck with the end stop members to reduce to a minimum, thereby facilitating the movement of the slider into and out of engagement with the end stop members.

3 Claims, 6 Drawing Figures

SLIDE FASTENER

BACKGROUND OF THE INVENTION

1. Field of the Invention

This invention relates generally to slide fasteners and more particularly to an end stop means for limiting the closing or upward movement of a slider at the upper end of a slide fastener.

2. Prior Art

A typical upper end stop means of the type now under consideration comprises a cooperative pair of end stop members of identical configuration fixedly secured to a pair of stringer tapes at their upper ends in opposed relation to each other. When the slide fastener is closed, the end stop members are received in a pair of outwardly diverging throats of the slider which are defined by a pair of upper and lower wings and a neck interconnecting the wings at its front end, with their opposed flat side faces in firm contact with the opposite side surfaces of the slider neck. The conventional end stop means has the disadvantage, however, that the movement of the slider into and out of engagement with the end stop members is rendered rather heavy and sluggish, particularly where the end stop means is employed in a slide fastener of the type for use in a bag or the like in which a pair of stringer tapes have their inner beaded or reinforced edges held together at their upper ends. This difficulty arises out of the fact that the end stop members offer considerable resistance to the movement of the slider due to the presence of their relatively large areas of contact with the slider neck which areas are represented by their opposed flat side faces.

SUMMARY OF THE INVENTION

It is therefore an object of this invention to provide an upper end stop means for slide fastener which has a minimum area of contact with the slider neck to permit the slider to smoothly move into and out of engagement with the end stop means.

According to the invention there is provided a slide fastener comprising a pair of oppositely disposed stringer tapes carrying on and along their confronting reinforced edges a pair of series of interengageable fastener elements. A slider is movable along the fastener elements to take the stringer tapes into and out of mutual engagement to close and open the slide fastener. The slider includes a pair of spaced apart upper and lower wings interconnected by a neck located centrally of its front end to define a generally Y-shaped guide channel through the slider for guiding the movement of the fastener elements therethrough. The slider neck has an inwardly converging rear end portion. A pair of end stop members of identical make are provided for limiting the closing movement of the slider, the end stop members being fixedly secured to the tape edges at their upper ends in opposed relation to each other. The end stop members are received in the guide channel when the slider is in its uppermost position. Each of the end stop members has a recess formed in its inner side and lying between its inner front and rear corners. The recess has an intermediate flat portion. When the slider is in its uppermost position, the opposed inner front corners of the end stop members are disposed in engagement with the opposite sides of the slider neck with their inner rear corners in abutment with each other so that the opposed recesses cooperate with the inwardly converging rear end portion of the slider neck to define a generally V-shaped gap therebetween to prohibit any part of the slider neck to make contact with the opposed intermediate flat portions until the front end of the slider neck comes into contact therewith when the inwardly converging rear end portion of the slider neck passes through the abutted inner rear corners of the end stop members.

Many other advantages and features of the present invention will become manifest to those versed in the art upon making reference to the detailed description and the accompanying sheets of drawings in which a preferred structural embodiment incorporating the principles of the present invention is shown by way of example.

DETAILED DESCRIPTION OF THE PREFERRED EMBODIMENT

Figure 1:
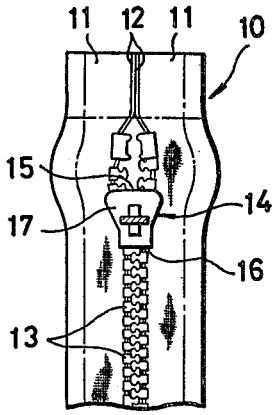
FIG. 1 is a front elevational view of a slide fastener incorporating a cooperative pair of end stop members provided in accordance with the present invention.

FIG. 1 shows a slide fastener 10 including a pair of oppositely disposed stringer tapes 11,11 carrying on and along their confronting reinforced or beaded edges 12,12 a pair of series of uniformly spaced, interengageable fastener elements 13, the pair of stringer tapes being taken into and out of mutual engagement by a slider 14 movable along the fastener elements 13 to close and open the slide fastener 10.

The slider 14 includes a body 14a having a flared front end 15 and a contracted rear end 16 and having a pair of parallel spaced apart upper and lower wings 17,17 interconnected by a neck or diamond 18 located centrally of its front end 15 to define a generally Y-shaped guide channel 19 through the slider body **14*a* for guiding the movement of the fastener elements 13 therethrough. Each of the upper and lower wings 17,17 has a pair of inwardly directed guide flanges 20,20 formed on and along opposite lateral marginal edges thereof, the guide flanges 20,20 terminating short of the slider front end 15. The slider neck 18 includes a solid body 18*a* of a modified pentagon-shaped or spear head-shaped cross section having a flat front end 21 and a rounded rear end 22, the flat front end 21 being substantially greater in width or a dimension in the transverse direction of the slider body 14*a* than the rear end 22. The neck body 18*a* has at its opposite sides a pair of tapered flat front surfaces 23, 23 converging from the opposite vertices 24,24 toward its front end 21 and another pair of tapered flat rear surfaces 25,25 converging from the opposite vertices 24,24 toward and merging into its rear end 22. The slider neck 18*a* is arranged symmetrically with respect to its longitudinal axis. The slider 14 is provided with a pull tab (not shown) pivotably mounted on its upper wing 17 by which the slider 14 is manipulated to move along the fastener elements 13** in the fastener opening and closing directions in the well known manner.

A top end stop means 26 embodying the principles of the present invention is provided for arresting the closing movement of the slider 14 along the fastener elements 13 at a predetermined point adjacent to the upper end of the slide fastener 10 to prevent the slider 14 from running off the fastener elements 13. The end stop means 26 comprises a cooperative pair of end stop members 27,27 of identical make each including a solid body 27a of generally rectangular shape and a pair of spaced apart rims 28,28 formed integrally with and projecting outwardly from the end stop body 27a throughout the length thereof. The end stop 27a has a pair of flat front and rear end faces 29,30 and a pair of flat top and bottom faces 31,31. The end stop body 27a has one side facing away from the rims 28,28 recessed as at 33. The recess 33 is defined by an intermediate flat wall portion 34 disposed substantially right-angularly to the top and bottom faces 31, and a pair of longitudinally spaced, flat front and rear wall portions 35,36 extending from the intermediate wall portion 34 toward the front and rear end faces 29,30 and merging into the inner front and rear rounded corners 37,38, respectively, the front and rear wall portions 35,36 being inclined or oriented angularly with respect to the intermediate wall portion 34. The end stop member 27 is arranged symmetrically both with respect to a plane lying centrally of the thickness of its body 27a between the top and bottom faces 31,31 and with respect to a plane lying centrally of the length of its body 27a between the front and rear end faces 29,30.

Figure 2:
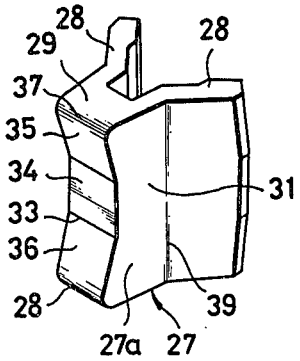
FIG. 2 is an enlarged, perspective view of the end stop member.

The cooperative pair of end stop members 27,27 are fixedly mounted on the respective stringers 11,11 in opposed relationship to each other with each pair of rims 28,28 disposed astride and in firm clamping engagement with the beaded tape edge 12. Although the end stop members 27,27 are best suited for use in a slide fastener of the type in which a pair of inner tape edges are held together at their upper ends, as shown in the drawings, they may also be employed in a slide fastener of the type in which the upper end portions of stringer tapes lying beyond the end stop means are spread apart to assume a Y-shaped configuration. Prior to attachment of the end stop members 27,27 to the stringer tapes 11,11, the pair of rims 28,28 are initially flared or bent away from each other along respective lines 39,39 lying adjacent to the end stop body 27a as shown in FIG. 2. When mounting each of the end stop members 27,27 to the stringer tapes 11,11, the pair of rims 28,28 are deformed under compression in a suitable machine or by suitable tools relative to the end stop body 27a from an open spread-apart configuration to a compressed-together, substantially parallel configuration for firm gripping engagement with the beaded tape edge 12 to thereby prevent the sliding movement ofthe end stop member 27 therealong.

Figure 3A:
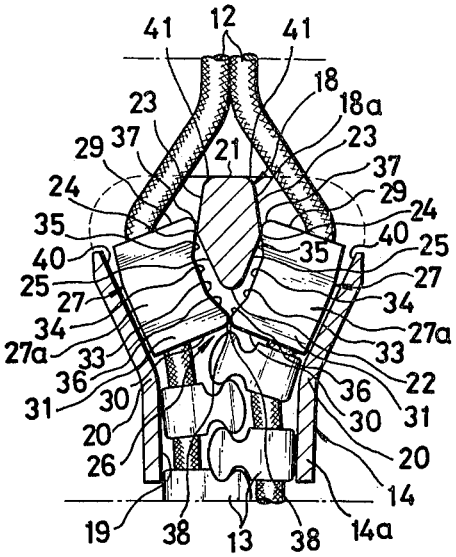
FIGS. 3A through 3D inclusive are plan views of the slide fastener with the stringer tapes removed, showing the progressive stages of operation of the slider.
Figure 3B:
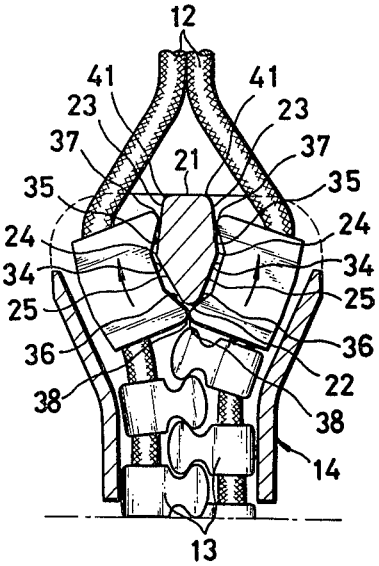
Figure 3C:
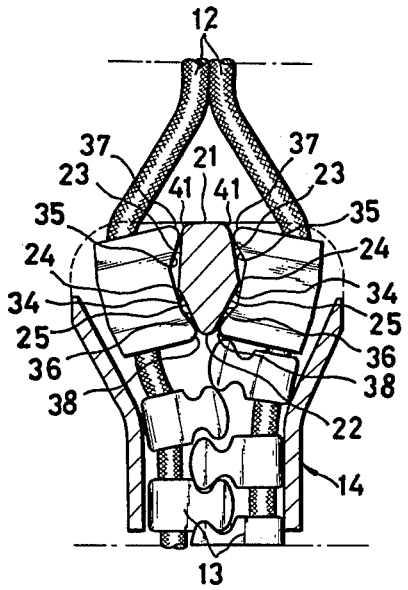

FIG. 3A shows the slider 14 in its uppermost position in which the slider 14 is held in engagement with the pair of end stop members 27,27 to be prevented from further moving upwardly. The end stop members 27,27 are fully received in a pair of outwardly diverging throats 40,40 of the slider 14 which constitute part of the guide channel 19, with the opposed inner rear rounded corners 38,38 in abutting engagement with each other and with the respective outer edges of the end stop members 27,27 disposed closely adjacent to the guide flanges 20,20. In this condition, the pair of end stop members 27,27 are not disposed in engagement with the slider neck 18 except that the inner front rounded corners 37,37 are held in contact with the outwardly converging front side surfaces 23,23 immediately adjacent to the vertices 24,24. The pair of recesses 33,33 and the inwardly converging rear side surfaces 25,25 define a generally V-shaped gap or space as shown in FIG. 3A. As the slider 14 is manipulated by the pull tab to move or start off downwardly to open the slide fastener 10, the rear end 22 of the slider neck 18 is first brought into contact with the rear wall portions 36,36 adjacent to the abutted rear corners 38,38, with the front corners 37,37 in sliding engagement with the outwardly converging front side surfaces 23,23 and with the opposite vertices 24,24 disposed substantially in alignment with the corners of the respective recesses 33,33 into which the respective front and intermediate wall portions 35,34 merge, as shown in FIG. 3B. The depth of the recess 33 is so related to the greatest width of the neck 18 between the opposite vertices 24,24 that during this initial starting movement of the slider 14, the vertices 24,24 will not contact the respective recesses 33,33 as shown in FIG. 3B. Thus, no part of the neck 18 except for the outwardly converging front side surfaces 23,23 makes contact with the end stop members 27,27 until the rear end 22 is brought into engagement with the rear wall portions 36,36 adjacent to the abutted rear corners 38,38, which will greatly facilitate the initial starting movement of the slider. As the slider is further moved downwardly, the abutted rear corners 36,36 are forced laterally apart by the neck rear end 22 intruding therebetween to move the end stop members 27,27 in the directions of the arrows A,A (FIG. 3B), with the front corners 37,37 still in sliding engagement with the front side surfaces 23,23 adjacent to the neck front end 21 and with the vertices 24,24 disposed approximately centrally of the intermediate wall portions 34,34 in spaced apart relation thereto, as shown in FIG. 3C. As the starting movement of the slider off the end stop members 27,27 is continued, the inwardly converging rear side surfaces 25,25 urge the stop members 27,27 laterally further away from each other with the front corners 37,37 out of engagement with the front side surfaces 23,23 and with the front corners 41,41 of the neck 18 in turn in sliding contact with the front wall portions 25,25.

Figure 3D:
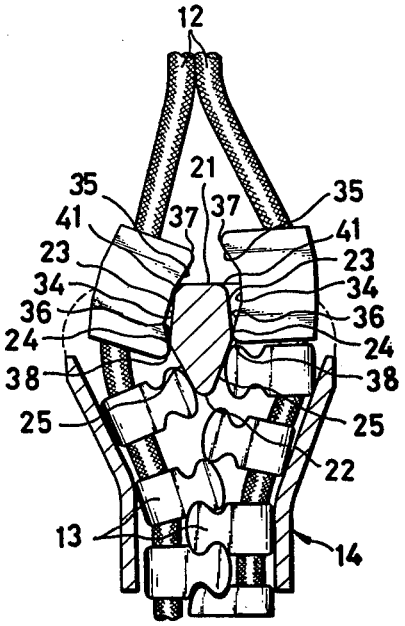

The slider neck 18 in its entirety is held away from the intermediate wall portions 34,34 until one or both of the front corners 41,41 of the neck come into contact therewith when the vertices 24,24 pass through the inner rear corners 38,38. One of the front corners 41,41 is shown in FIG. 3D engaging the corresponding intermediate wall portion 34. Now that the rear corners 38,38 which have been in sliding engagement with the inwardly converging rear side surfaces 25,25 are in sliding contact with the outwardly converging front side surfaces 23,23, the engagement of the neck 18 with one or both of the intermediate wall portions 34,34 will not adversely affect the starting movement of the slider 14 off the end stop members 27,27.

When the slider 14 moves into its uppermost position for engagement with the end stop members 27,27 this slider starting operation is reversed.

Since the areas of contact of the pair of end stop members 27,27 with the slider neck 18 are reduced to a minimum, the slider 14 can smoothly be moved into and out of engagement with the end stop members 27,27.

Although various minor modifications may be suggested by those versed in the art, it should be understood that I wish to embody within the scope of the patent warranted hereon, all such embodiments as reasonable and properly come within the scope of my contribution to the art.

What is claimed is:

1. A slide fastener comprising: a pair of stringer tapes; a pair of series of fastener elements; a slider including a pair of spaced apart upper and lower wings interconnected by a neck located centrally of its front end, which neck has a flat front end, a rounded rear end, a pair of tapered flat front surfaces converging from opposite vertices toward said front end, and a pair of tapered flat rear surfaces converging from said opposite vertices toward and merging into said rear end; and a pair of end stop members fixedly secured to respective marginal edges of said tapes at their upper ends in opposed relation to each other, each of said end stop members including a solid body of generally rectangular configuration having a top and a bottom flat face and a front and rear flat end face, and recess formed in its inner side and lying between its inner front and rear corners, said recess having an intermediate flat portion and front and rear flat portions spaced apart by and inclined inwardly toward said slider neck with respect to said intermediate flat portion, said inner front and rear corners of each of said end stop members being rounded, the areas of contact of the pair of end stop members with the slider neck being reduced to a minimum having a gap therebetween when the slider moves into or out of its uppermost position, each end stop body further having a pair of spaced apart rims formed integrally with and projecting from said end stop body throughout the length thereof, said rims being deformable relative to said end stop body from a spread-apart configuration to a compressed-together, substantially parallel configuration to firmly grip said tape edge.

2. A slide fastener according to claim 1, in which each of said end stop members is arranged symmetrically both with respect to a plane lying centrally of the length thereof between said front and rear end faces and with respect to a plane lying centrally of the thickness thereof between said top and bottom faces.

3. In a slide fastener including a pair of oppositely disposed stringer tapes each carrying a row of fastener elements, the fastener elements carried by one stringer tape being interengageable with the fastener elements carried by the other stringer tape, a slider having wings and a neck together defining a generally Y-shaped channel for guiding the rows of fastener elements through the slider, said slider being movable in a forward direction to bring fastener elements of said rows into interengagement for closing the slide fastener, and being movable in a rearward direction to disengage interengaged fastener elements of said rows for opening the slide fastener, the improvement which comprises said neck having lateral boundaries defined by a first pair of converging surfaces and a second pair of converging surfaces adjoining respective surfaces of said first pair of converging surfaces; and a pair of end stop members, each connected to a corresponding stringer tape, said end stop members being engageable with each other and engageable with respective surfaces of said first pair of converging surfaces to block further forward movement of the slider upon arrival of said slider at a forward limit position along the stringer tapes, said end stop members being generally similar in configuration and each having a forward corner portion and a rear corner portion separated from said forward corner portion by a recess portion, the forward corner portions, rear corner portions and recess portions of said end stop members being so configured that when the slider is at said forward limit position, the rear corner portions of said end stop members only engage each other, the forward corner portion of each end stop member only engages a respective surface of said first pair of converging surfaces, and the recess portions and rear corner portions of said end stop members are located to define a generally V-shaped clearance space opposite said second pair of converging surfaces.

* * * * *